US006517378B2

(12) United States Patent
Fumikura

(10) Patent No.: US 6,517,378 B2
(45) Date of Patent: Feb. 11, 2003

(54) CARD EDGE CONNECTOR

(75) Inventor: Tadahiro Fumikura, Chiba (JP)

(73) Assignee: Tyco Electronics. AMP, K.K., Kanagawa (JP)

( * ) Notice: Subject to any disclaimer, the term of this patent is extended or adjusted under 35 U.S.C. 154(b) by 0 days.

(21) Appl. No.: 10/008,674

(22) Filed: Dec. 7, 2001

(65) Prior Publication Data

US 2002/0072263 A1 Jun. 13, 2002

(30) Foreign Application Priority Data

Dec. 8, 2000 (JP) ..... 2000-375054
Apr. 18, 2001 (JP) ..... 2001-119444

(51) Int. Cl.[7] ..... H01R 13/627
(52) U.S. Cl. ..... 439/570; 439/326
(58) Field of Search ..... 439/570, 569, 439/571, 83, 876, 326, 327

(56) References Cited

U.S. PATENT DOCUMENTS 5,591,047 A * 1/1997 Yamada et al. ..... 439/570
5,827,085 A * 10/1998 Yodogawa ..... 439/570
6,030,245 A * 2/2000 Choy ..... 439/326
6,193,547 B1 * 2/2001 Tung ..... 439/570
6,231,364 B1 * 5/2001 Liu ..... 439/326
6,280,247 B1 * 8/2001 Wu et al. ..... 439/570

FOREIGN PATENT DOCUMENTS

JP 2562970 11/1997
JP 11085861 3/1999

* cited by examiner

*Primary Examiner*—Gary Paumen
(74) *Attorney, Agent, or Firm*—Barley, Snyder, Senft & Cohen, LLC

(57) ABSTRACT

A card edge connector comprising a housing and a latch member. The housing is attached to a mother board. The latch member has a latch body and a fixing member. The latch body having a housing attaching portion for attachment to the housing and a daughter board holding portion for holding a daughter board. The fixing member separated from the latch body and attached to the mother board. The fixing member mounted on a tab portion formed from the latch body. The tab portion having a broad section and a narrow section having a width smaller than the broad section such that the tab portion is movable in a predetermined range in the vertical direction.

20 Claims, 9 Drawing Sheets

CARD EDGE CONNECTOR

BACKGROUND OF THE INVENTION

The present invention relates to card edge connectors, and more particularly, to a card edge connector mounted on a mother board that freely loads and unloads a daughter board.

DESCRIPTION OF THE PRIOR ART

Card edge connectors, such as those commonly used in personal computers, are mounted on a mother board and freely load and unload a daughter board such as a single inline memory module (SIMM) or double inline memory module (DIMM). An example of one such card edge connector is disclosed in Japanese Patent Laid Open No. 2000-208183 A and is shown in FIGS. 8A through 8C. FIG. 8A shows a card edge connector 101 comprising an insulating housing 110 mounted on a mother board A. The housing 110 has a daughter board receiving recess 111 extending in the longitudinal direction, and a plurality of contacts (not shown) mounted in two upper and lower arrays along the longitudinal direction of the housing 110 that attach to the mother board A. After a daughter board B has been inserted at a first angle into the daughter board receiving recess 111, shown in FIG. 8A, it is pivoted into a second angle, shown in FIG. 8B. The daughter board B is held in place at the second angle by a pair of metal latch members 120 located at both ends of the housing 110 in the longitudinal direction.

Each latch member 120 is formed by stamping and forming a metal plate, and includes a press fit plate portion 121 and a daughter board holding portion 122. Shown in FIG. 8C, the press fit plate portion 121 is press-fitted into a latch receiving recess 112 formed at the ends of the housing 110 in the longitudinal direction and is provided with an anti-overstress piece 123 extending forward from its front end. The anti-overstress piece 123 is provided with a fixing portion 124 bent inward from the bottom end thereof. The fixing portion 124 is soldered onto the mother board A, thereby fixing the latch member 120 to the mother board A.

The daughter board holding portion 122 comprises a plate portion 122*a*, a hook portion 122*b*, and a daughter board latching piece 122*c*. The plate portion 122*a* is bent substantially forward in the shape of a "U" from the back end of the press fit plate portion 121. The hook portion 122*b* is in the shape of a hook and is located forward from the plate portion 122*a* and projects inward. The daughter board latching piece 122*c* is bent inward from the top end of the plate portion 122*a*. When the daughter board B is inserted into the daughter board receiving recess 111 and is pivoted from the first angle to the second angle, the elasticity of the plate portion 122*a* temporarily causes the daughter board latching piece 122*c* to shift outward. When it returns to its original position, the daughter board latching piece 122*c* makes contact with the upper surface of the edge of the daughter board B to fix it in position. The hook portion 122*b* enters the notch (not shown) formed in the edge of the daughter board B, further preventing the daughter board B from slipping off the card edge connector 101 when the daughter board B is positioned at the second angle.

Several problems, however, are associated with the card edge connector 101. In the card edge connector 101, the fixing portion 124 that is soldered to the mother board A is bent from the anti-overstress piece 123 that is integrally formed with the other portions comprising the latch member 120. Thus, if the mother board A is warped, the warp of the mother board A can not be absorbed by the fixing portion 124 when it is soldered to the mother board A. As a result, the card edge connector 101, including the latch member 120, can not be properly soldered to the motherboard A if the warp is larger than a predetermined range, even though the coplanarity of the entire connector assembly is within the predetermined range.

In an effort to overcome this problem, devices such as Japanese Utility Model Laid Open No. 5-23429 U, shown in FIGS. 9A through 9C, have been developed. FIG. 9A shows a surface mount type connector 201 mounted on the surface of a circuit board (not shown). The connector 201 comprises an insulating housing 210 and a plurality of contacts 220. The contacts 220 are attached to the housing 210 and have a solder connection portion 221 for attachment to the circuit board. Slots 211 penetrate in the vertical direction and are formed at both ends of the housing 210 in the longitudinal direction. Both sides of the slots 211 have shoulders 212. A metal peg 230 in the shape of an "L" and having a slit 232 and barbs 231 at both edges is attached within the slots 211. The metal peg is movable in a predetermined range in the vertical direction. The bottom surface of the peg 230 is soldered to the circuit board to reinforce the connection between the circuit board and the connector 201. The peg 230 is inserted downward into the slot 211 and between the shoulders 212. The upward movement of the peg 230 is thereby limited by the cooperation between the barbs 231 and the shoulders 212. The downward movement of the peg 230 is limited by the cooperation between the upper edge of the slit 232 and a projection 213 projecting from the housing 210 to the slot 211.

Because the peg 230 is movable in the vertical direction with respect to the housing 210 within a predetermined range, the peg 230 is also movable in the vertical direction with respect to the solder connection portion 221 of the contact 220 within a predetermined range. Therefore, when the contact 220 and the peg 230 are soldered to the circuit board, any warping of the circuit board can be absorbed. However, since the metal peg 230 is directly mounted in the slot 211, the barbs 231 on the peg 230 can chip the sides of the slot 211 when the peg 230 is mounted. When the sides of the slot 211 are chipped, the peg 230 can become displaced within the slot 211.

In view of the above-mentioned problems, it is therefore desirable to develop a card edge connector that is capable of absorbing the warp of a mother board when the entire connector, including the fixing member, is soldered to the mother board. It is further desirable to develop a card edge connector where the mother board fixing member is protected from displacement from the latch body.

SUMMARY OF THE INVENTION

This invention relates to a card edge connector comprising an insulating housing mounted on a mother board and a latch member. The latch member comprises a latch body having a housing attaching portion attached to the housing and a daughter board holding portion for holding a daughter board. The fixing member is separated from the latch body and is attached to the mother board. The fixing member is mounted on a tab portion formed from the latch body that is moveable in a predetermined range in the vertical direction.

DETAILED DESCRIPTION OF THE PREFERRED EMBODIMENT

Figure 1A:
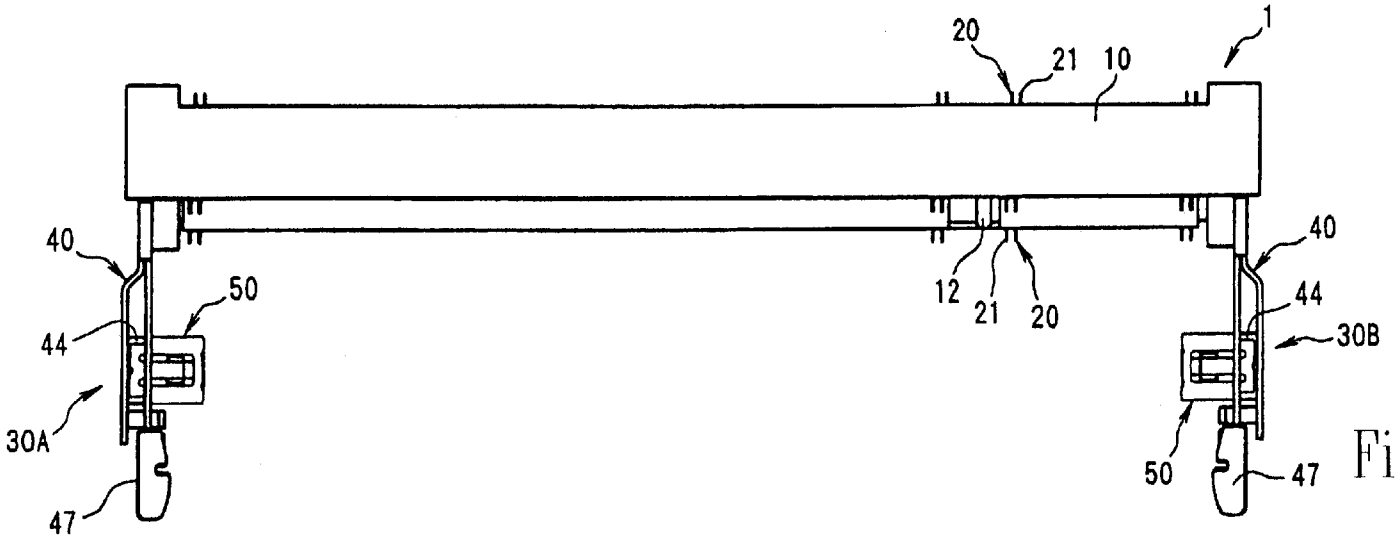
FIG. 1A is a plan view of a first embodiment of the card edge connector.

FIGS. 1A through 5 show a first embodiment of a card edge connector 1. FIGS. 1A, 1B, and 1C show the card edge connector 1 comprising an insulating housing 10 and a plurality of contacts 20. The insulating housing 10 has a substantially rectangular insulating member that extends in the longitudinal direction and is formed by molding a synthetic resin, such as PBT. It should be understood by those skilled in the art, however, that other resins could be used to obtain substantially similar results. The insulated housing 10 is mounted on a mother board A and has a daughter board receiving recess 11 extending in the longitudinal direction (the horizontal direction in FIG. 1B). The contacts 20 are arranged in two upper and lower arrays in the longitudinal direction of the housing 10. Each contact 20 comprises a solder connection portion 21 for attachment to the surface of the mother board A. A rib 12, shown in FIG. 1B, is positioned to the right of the center of the housing 10 in the longitudinal direction to prevent the reverse side insertion of a daughter board B.

At both ends of the housing 10, in the longitudinal direction, is a pair of latch members 30A, 30B. The latch members 30A, 30B fix the daughter board B at a second angle substantially parallel to the mother board A. The daughter board B is inserted between the plurality of contacts 20 arranged in the two upper and lower arrays until it is received at a first angle in the daughter board receiving recess 11. The daughter board B touches the contacts 20 in the two upper and lower arrays and is pivoted until it reaches the second angle. As a result, the daughter board B is electrically connected to the mother board A. The latch members 30A, 30B are symmetrically set about the center of the housing 10. The latch member 30A is positioned to the left of the center of the housing 10 in the longitudinal direction, and the latch member 30B is positioned to the right of the center of the housing 10 in the longitudinal direction. Because the latch members 30A, 30B are symmetrically arranged, it will be appreciated by those skilled in the art that while the left side latch member 30A will be described herein, the right side latch member 30B will have a similar configuration.

Figure 1B:
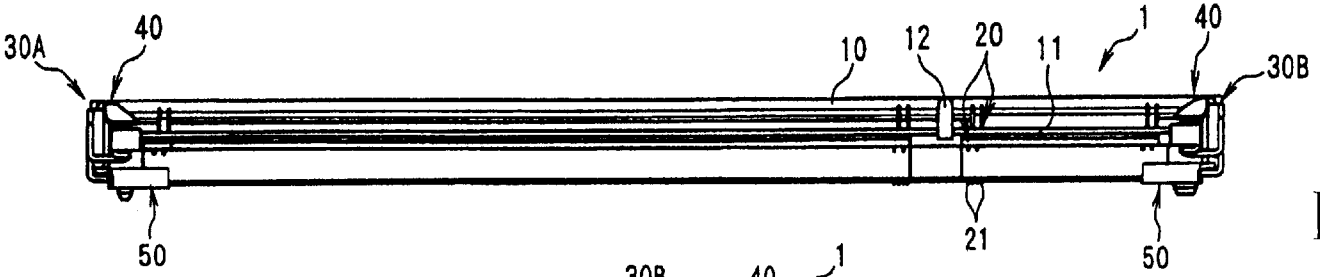
FIG. 1B is a front view of the first embodiment of the card edge connector.

As shown in FIG. 1B, the latch member 30A comprises a metal latch body 40 and a metal fixing member 50 separated from the latch body 40. The latch body 40 is formed by stamping and forming a metal plate, such as stainless steel, and comprises a housing attaching portion or press fit plate portion 41 to be press fitted to the housing 10, shown in FIGS. 2B and 2C. It should be appreciated by those skilled in the art, however, that other materials can be used to obtain a substantially similar result. Shown in FIG. 3, at the front end of the press fit plate portion 41 a transition portion 43*a* extends diagonally forward and outward. A first plate portion 43 extends forward from the tip of the transition portion 43*a*. At the front end and on the upper edge of the press fit plate portion 41, a folded end 42 extends upward and then is folded down and inward. On the front edge of the folded end 42, a second plate portion 46 extends forward and substantially parallel to the first plate portion 43. A plurality of projections 48 project outward from the folded end 42 to maintain a predetermined distance between the first plate portion 43 and the second plate portion 46.

At the front end of the second plate portion 46, a daughter board holding portion 47 holds the daughter board B at the second angle. The daughter board holding portion 47 comprises a daughter board stopper 47*a* and a daughter board holding piece 47*b*. The daughter board stopper 47*a* extends from the front end of the second plate portion 46 and bends inward at a predetermined angle. The daughter board holding piece 47*b* bends inward from the upper edge of the second plate portion 46. When the daughter board B is inserted at the first angle into the daughter board receiving recess 11 and is pivoted to the second angle, the daughter board holding piece 47*b* moves outward as a result of the elasticity of the second plate portion 46. When the daughter board B is received at the second angle, the daughter board holding piece 47*b* returns to its original position and makes contact with an upper surface of an edge of the daughter board B to fix it into position. In this position, the daughter board holding piece 47*b* fixes the daughter board B by preventing the lift-free performance of the daughter board B. The daughter board stopper 47*a* enters the notch (not shown) formed in the edge of the daughter board B when the daughter board B is located at the second angle, thereby preventing the daughter board B from slipping-off the connector 1 in the forward direction. Provided at the front end of the lower edge and the rear end of the lower edge of the second plate portion 46 are daughter board supporting portions 49*a*, 49*b*. The daughter board supporting portions 49*a*, 49*b* extend inward and support the daughter board B when the daughter board B is located at the second angle. The daughter board supporting portion 49*a*, 49*b* are located in different surface positions such that their upper surfaces can vary in height to accommodate warp of the daughter board B when the daughter board B is located at the second angle.

Figure 2A:
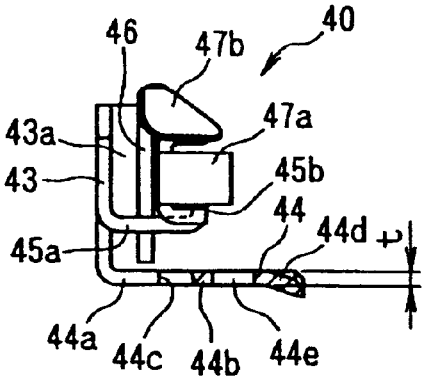
FIG. 2A is a partial sectional front view of a latch body showing a left latch member for use in the first embodiment of the card edge connector.
Figure 2B:
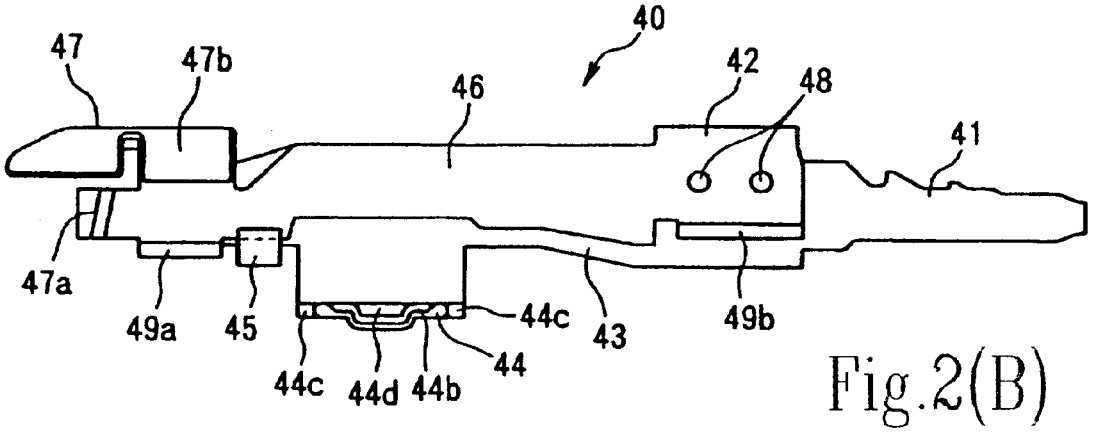
FIG. 2B is a right side view of the latch body showing the left latch member for use in the first embodiment of the card edge connector.
Figure 2C:
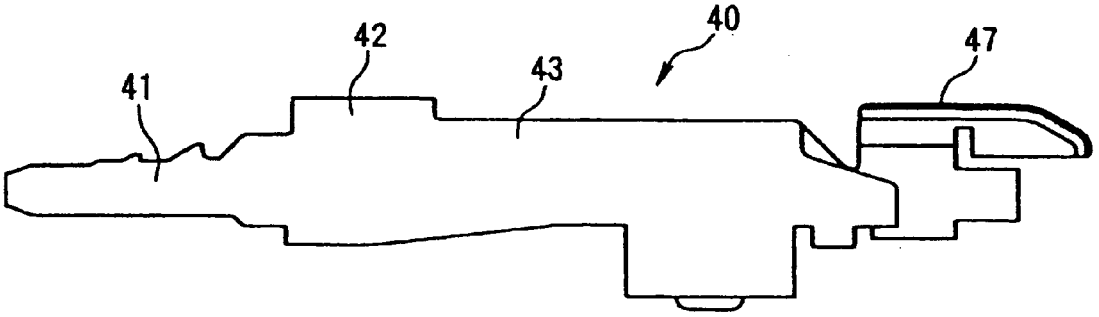
FIG. 2C is a left side view of the latch body showing the left latch member for use in the first embodiment of the card edge connector.
Figure 3:
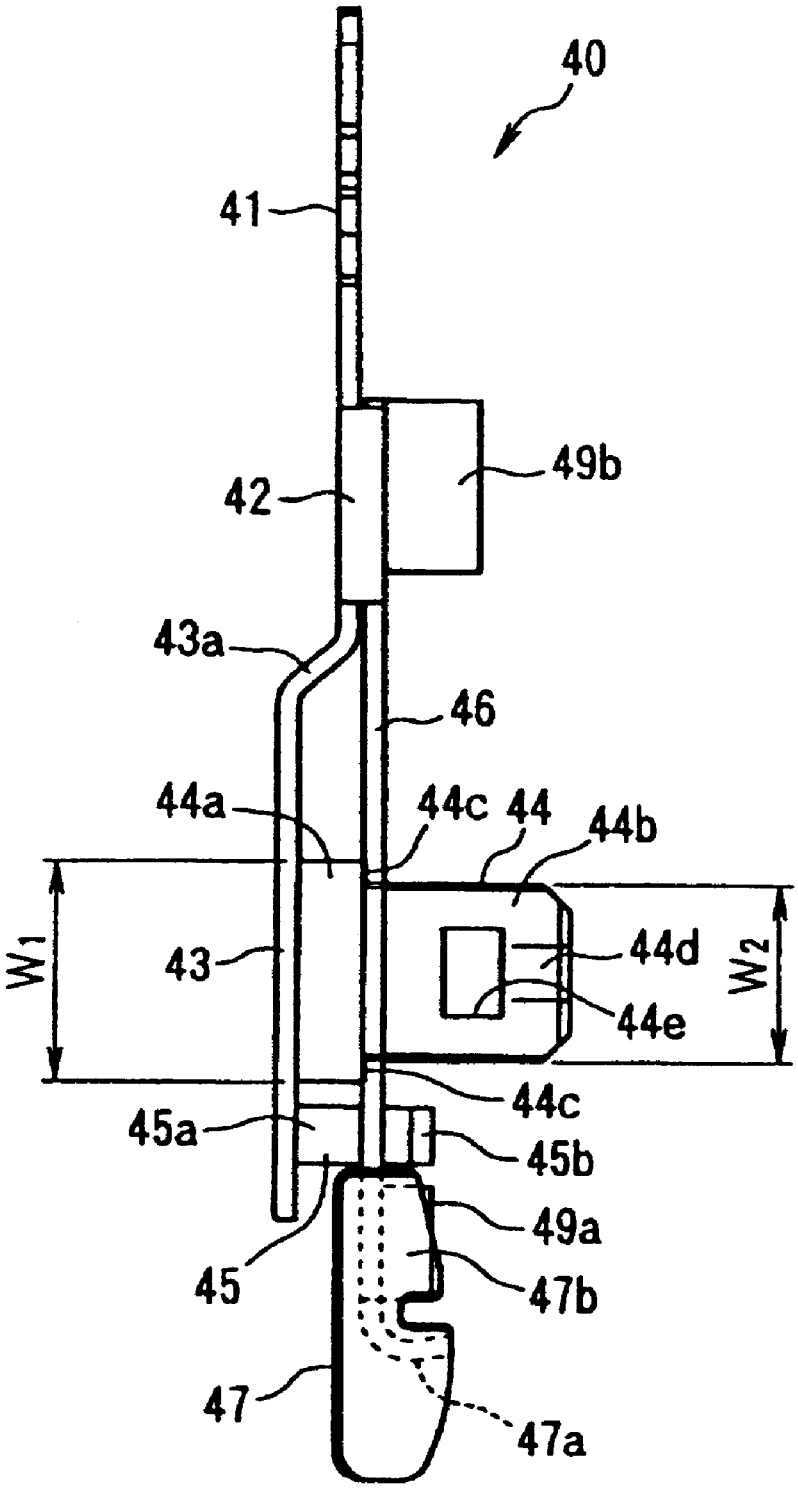
FIG. 3 is a plan view of the latch body used in the first embodiment of the card edge connector.
Figure 5:
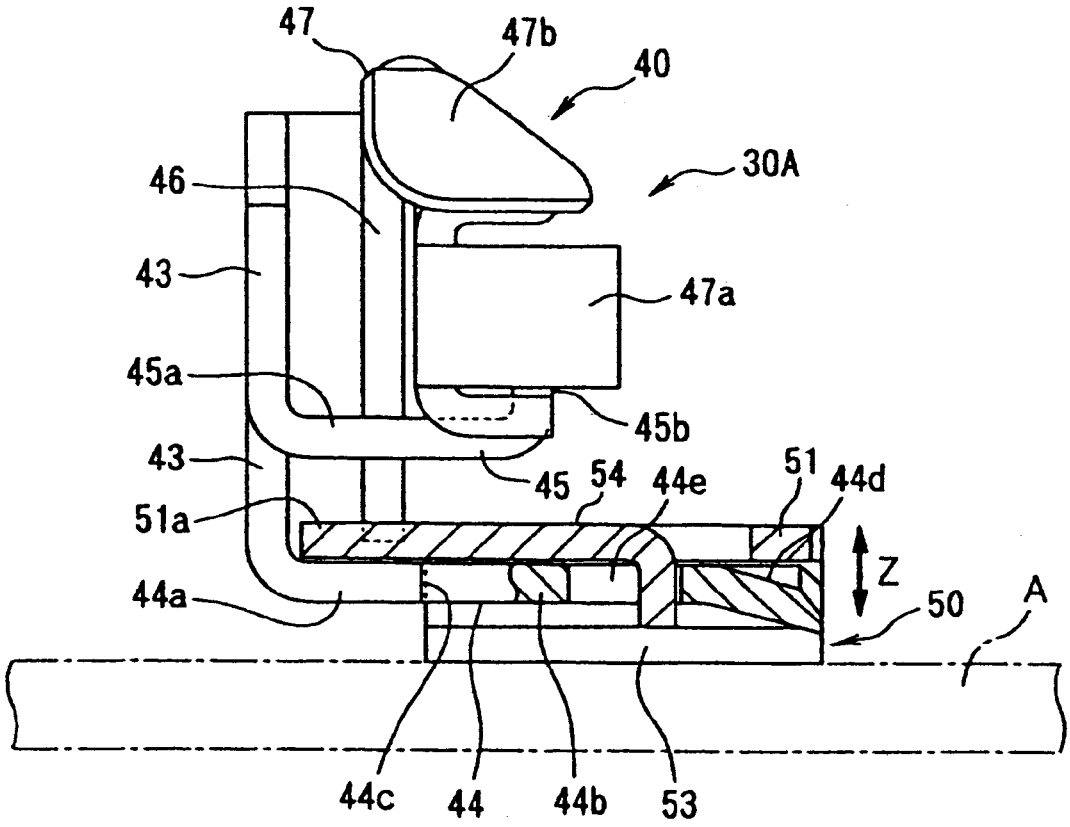
FIG. 5 is a partial sectional front view of the left latch member of the first embodiment of the card edge connector showing the fixing member soldered on the mother board.

A tab portion 44 having the plate thickness t, shown in FIG. 2A, is bent inward from the lower edge of the first plate portion 43. The tab portion 44 extends below the second plate portion 46 and comprises a broad section 44*a* and a narrow section 44*b*. The broad section 44*a* is bent inward from the first plate portion 43. The narrow section 44*b* extends inward from a tip of the broad section 44*a*. Shown in FIG. 3, the width $W_2$ of the narrow section 44*b* is smaller than the width $W_1$ of the broad section 44*a*. Engaging shoulders 44*c* are formed at the tip end of the broad section 44*a* and are located on both sides of the narrow section 44*b*, as shown in FIGS. 3 and 5. An engaging aperture 44*e* is formed vertically through the narrow section 44*b* of the tab portion 44. A tilting surface 44*d* at a tip of the narrow section 44*b* has a predetermined width and diagonally tilts upward toward the engaging aperture 44*e*.

An anti-over-movement piece 45 comprises a coupling portion 45*a* and a rising piece 45*b*. The coupling portion 45*a* is bent inward from the front end of the lower edge of the first plate portion 43 and is located below the second plate portion 46. The rising piece 45*b* projects from the tip of the coupling portion 45*a*. The second plate portion 46 is located between the first plate portion 43 and the rising piece 45*b* such that the outward movement of the second plate portion 46 can be limited by the first plate portion 43. The inward movement of the second plate portion 46 can be limited by the rising piece 45*b* of the anti-over-movement piece 45.

Figure 4A:
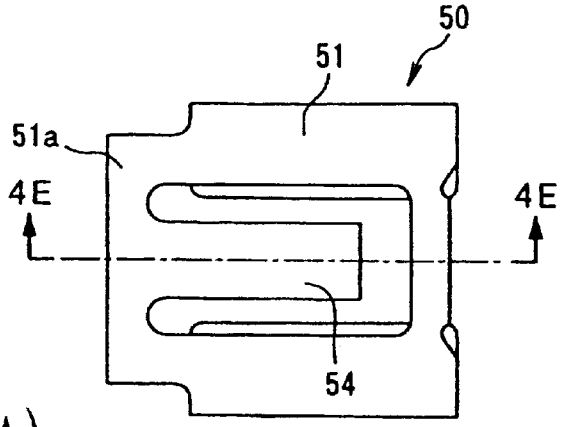
FIG. 4A is a plan view of a fixing member showing the left latch member for use in the first embodiment of the card edge connector.
Figure 4B:
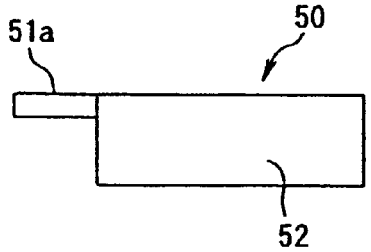
FIG. 4B is a front view of the fixing member showing the left latch member for use in the first embodiment of the card edge connector.
Figure 4C:
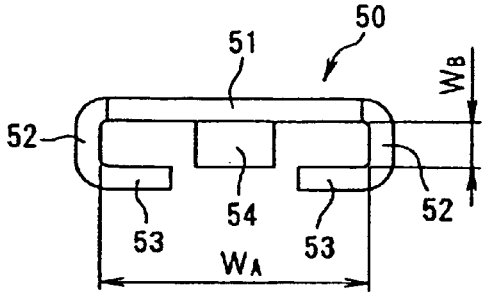
FIG. 4C is a left side view of the fixing member showing the left latch member for use in the first embodiment of the card edge connector.
Figure 4D:
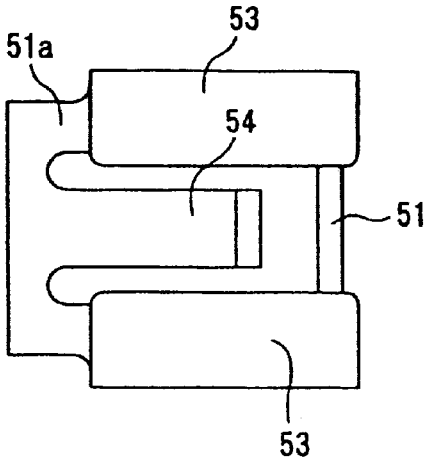
FIG. 4D is a bottom view of the fixing member showing the left latch member for use in the first embodiment of the card edge connector.
Figure 4E:
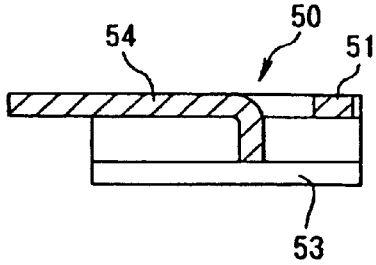
FIG. 4E is a sectional view along the line 4E—4E shown in FIG. 4A.

The fixing member 50 is formed by stamping and forming a metal plate, such as stainless steel, and is solder plated or tinned for connection by soldering. It should be appreciated by those skilled in the art, however, that other materials such as a copper alloy could be used to form the fixing member 50 for a substantially similar result. The fixing member 50 comprises a plate top portion 51, a pair of side plate portions 52, and a pair of plate bottom portions 53. The plate top portion 51 extends in the bending direction of the tab portion 44. The side plate portions 52 extend downward from both sides of the plate top portion 51. The plate bottom portions 53 extend toward each other from each of the lower ends of the side plate portions 52, as shown in FIGS. 4A through 4E. The plate top portion 51 of the fixing member 50 has a guide board portion 51*a* at the left end and an elastic engaging piece 54 extending from the left end to the right end in the bending direction of the tab unit 44. The elastic engaging piece 54 is a one-legged beam and has a width narrower than that of the tilting surface 44*d* formed on the tab portion 44. A tip of the elastic engaging piece 54 is bent until it is substantially adjacent to a top surface of the plate bottom portion 53. The width $W_A$ between the pair of side plate portions 52, shown in FIG. 4B, is larger than the width $W_2$ of the narrow section 44*b*, shown in FIG. 3, such that the narrow section 44*b* can be inserted therebetween. The width $W_B$ between the plate bottom portion 53 and the plate top portion 51, shown in FIG. 4B, is larger than the thickness t of the tab portion 44, shown in FIG. 2A.

The assembly of the card edge connector will now be described with reference to FIG. 5. The fixing member 50 is mounted on the tab portion 44 of the latch body 40 by pressing the guide board portion 51*a* toward the first plate portion 43 and adjacent to the upper surface of the narrow section 44*b* of the tab portion 44. When the fixing member 50 is mounted, the narrow section 44*b* of the tab portion 44 is inserted from the tip end into the space in the fixing member 50 enclosed by the plate top portion 51, the side plate portions 52, and the plate bottom portions 53. At this time, the narrow section 44*b* can be inserted by the guide board portion 51*a* by traveling along the upper surface of the narrow section 44*b* of the tab portion 44. The narrow section 44*b* of the tab portion 44 is inserted from its tip into the space in the fixing member 50, then the tip of the elastic engaging piece 54 slides on the tilting surface 44*d* formed at the tip of the narrow section 44*b*, deflecting the elastic engaging piece 54 upward. When the tip of the elastic engaging piece 54 reaches the engaging aperture 44*e*, then the elastic engaging piece 54 returns to its original position and engages with the edge of the engaging aperture 44*e*. The left edge of the side plate portions 52 touch the engaging shoulder 44*c* formed in the tab portion 44 in the tab bending direction. When the elastic engaging piece 54 is engaged with the engaging aperture 44*e*, the tip of the elastic engaging piece 54 is designed to slide on the tilting surface 44*d*. Thus, the tip of the elastic engaging piece 54 is smoothly led to the engaging aperture 44*e*.

When the elastic engaging piece 54 is engaged with the engaging aperture 44*e* and the left edge of the side plate portion 52 in the tab bending direction touches the engaging shoulder 44*c* formed on the tab portion 44, the movement in the bending direction of the tab portion 44 of the fixing member 50 is limited. The movement in the direction orthogonal to the tab bending direction of the fixing member 50 is also limited by the inside of the side plate portions 52 touching the side edge of the narrow section 44*b* of the tab portion 44. After the fixing member 50 is mounted on the tab portion 44, the fixing member 50 can be moved in the vertical direction Z, shown in FIG. 5, with respect to the tab portion 44. The downward movement of the fixing member 50 is limited by the lower surface of the plate top portion 51 of the fixing member 50 touching the upper surface of the narrow section 44*b*. The upward movement of the fixing member 50 is limited by the upper surface of the plate bottom portion 53 touching the lower surface of the narrow section 44*b*.

Figure 1C:
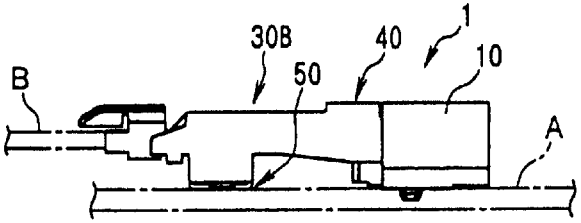
FIG. 1C is a right side view of the first embodiment of the card edge connector showing a mother board and a daughter board.

The latch members 30A, 30B are attached to both sides of the housing 10 in the longitudinal direction. The card edge connector 1 is then surface mounted on the mother board A. As shown in FIGS. 1C and 5, the solder connection portion 21 of the contacts 20 and the plate bottom portions 53 of the fixing members 50 of the latch members 30A, 30B are mounted in predetermined positions on the mother board A and then soldered by re-flow soldering. At this time, the fixing member 50 can be moved in the vertical direction Z, shown in FIG. 5, with respect to the tab portion 44 of the latch body 40 in a predetermined range. Thus, even if mother board A is warped, the warp can be absorbed by the vertical movement of the fixing member 50, allowing the solder connection portion 21 of the contacts 20 and the fixing member 50 to be successfully soldered to the mother board A.

Further, since the tab portion 44 of the latch body 40 and the fixing member 50 are made of metal, the risk of chipping is reduced when the fixing member 50 is mounted on the tab portion 44. Because the risk of chipping is reduced, the fixing member 50 is prevented from becoming displaced from the tab portion 44 of the latch body 40. Additionally, the movement in the tab bending direction of the fixing member 50 is limited by the left edge of the side plate portions 52 touching the engaging shoulder 44*c* and the elastic engaging piece 54 engaged with the engaging aperture 44*e*. The movement orthogonal to the tab bending direction of the fixing member 50 is limited by the side plate portions 52 touching the side edge of the narrow section 44*b* formed on the tab portion 44. Since the fixing member 50 can be moved in the vertical direction until the plate top portion 51 and the plate bottom portion 53 touch the narrow section 44*b*, the fixing member 50 can be mounted on the tab portion 44 movable in a predetermined vertical range with respect to the tab portion 44. Also, by inserting the narrow section 44*b* of the tab portion 44 from its tip into the space of the fixing member 50, the fixing member 50 can be easily mounted on the tab portion 44.

Figure 6B:
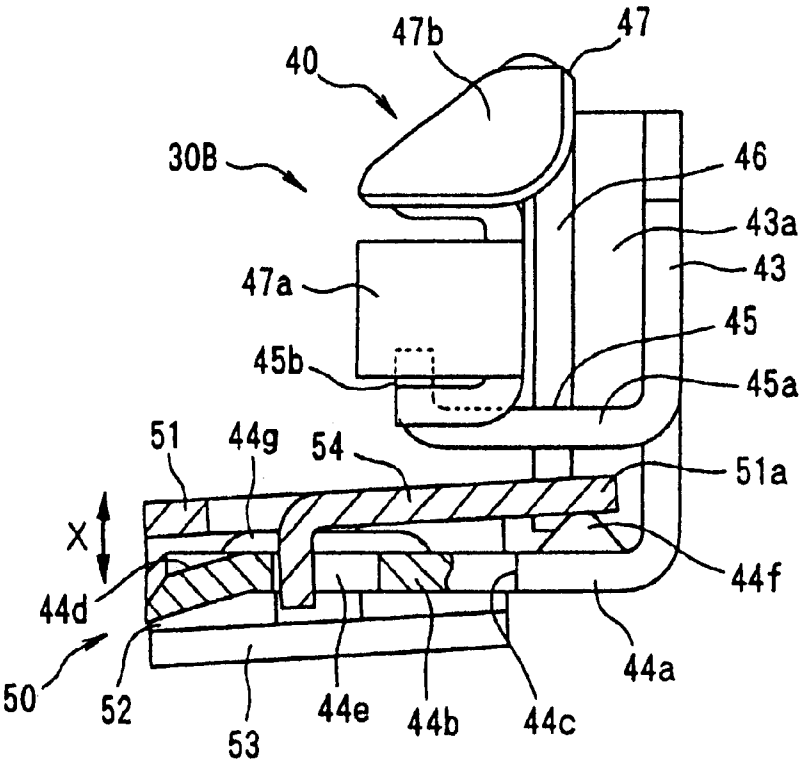
FIG. 6B is a partial sectional front view of the right latch member showing the second embodiment of the card edge connector with the fixing member rotated and inclined toward the latch member.
Figure 6A:
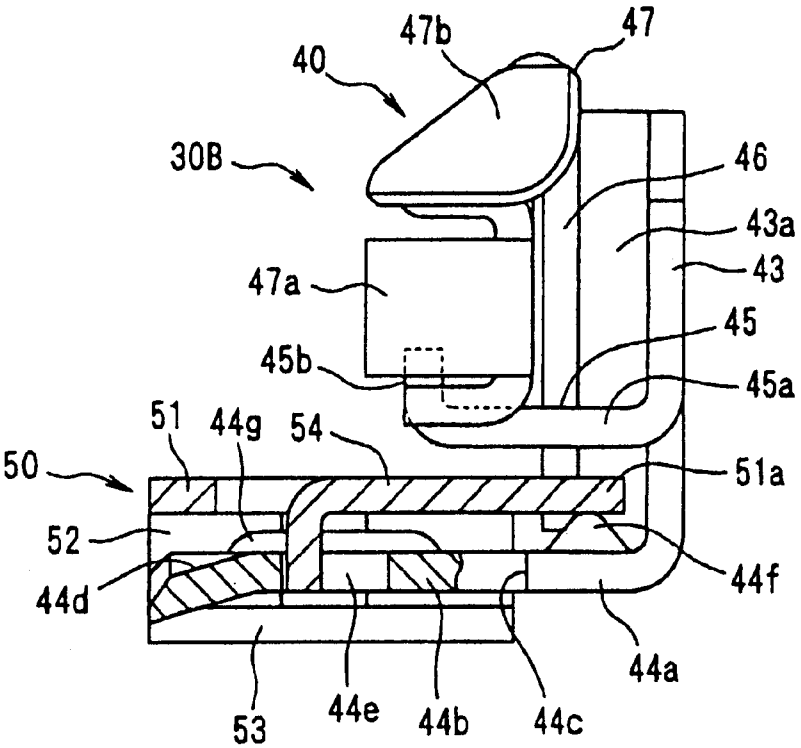
FIG. 6A is a partial sectional front view of a right latch member showing a second embodiment of the card edge connector with the fixing member set parallel to the latch member.
Figure 7:
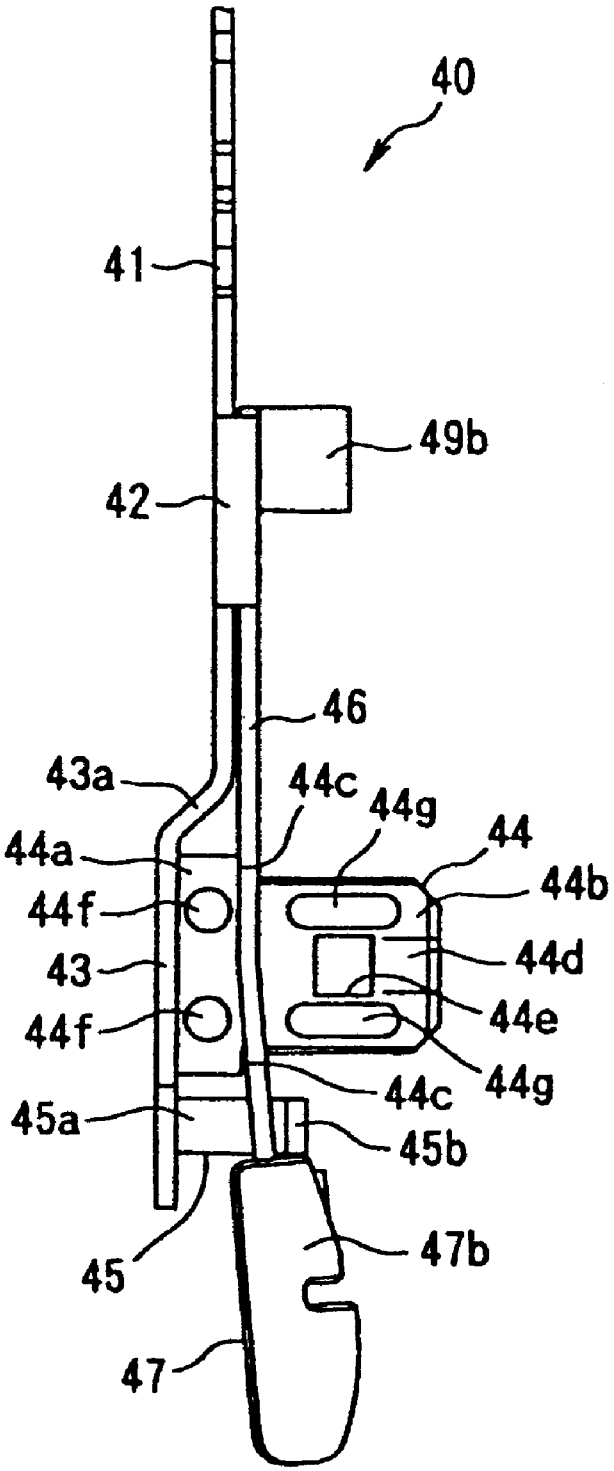
FIG. 7 is a plan view of the latch body of the second embodiment of the card edge connector.
Figure 8A:
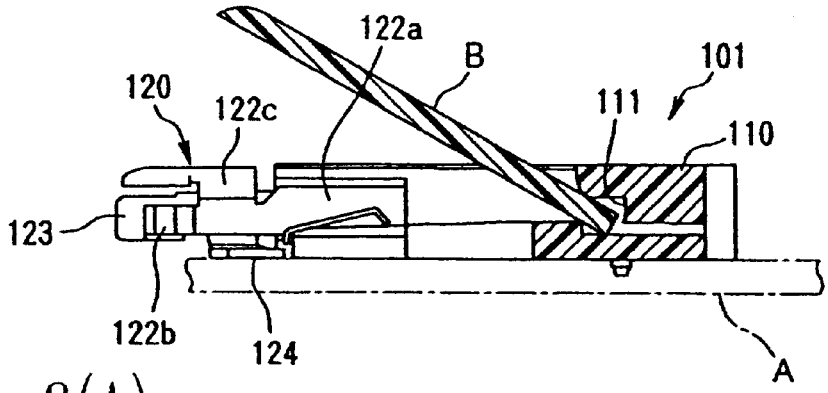
Fig.8(A) PRIOR ART
FIG. 8A is a sectional view of a card edge connector of the prior art showing the daughter board inserted at a first angle.
Figure 8B:
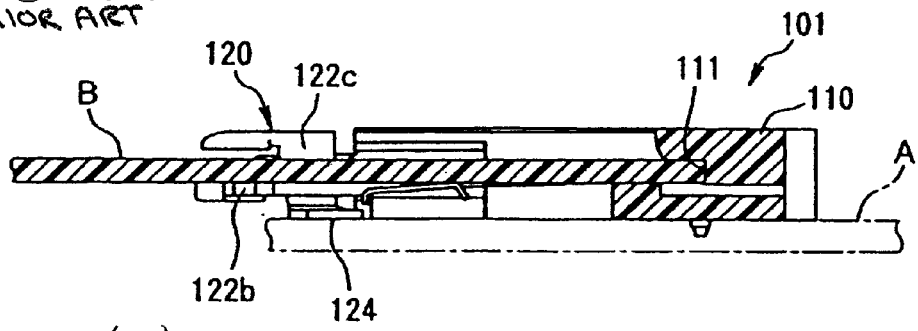
Fig.8(B) PRIOR ART
FIG. 8B is a sectional view of the card edge connector of the prior art showing the daughter board inserted at a second angle.
Figure 8C:
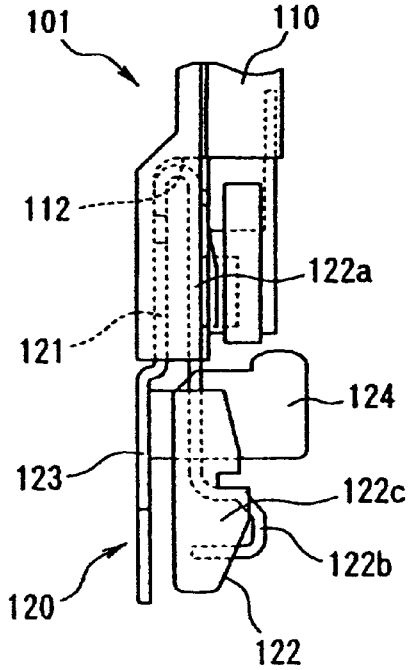
Fig.8(C) PRIOR ART
FIG. 8C is a partial plan view of the card edge connector of the prior art showing the latch member attached to the housing.
Figure 9A:
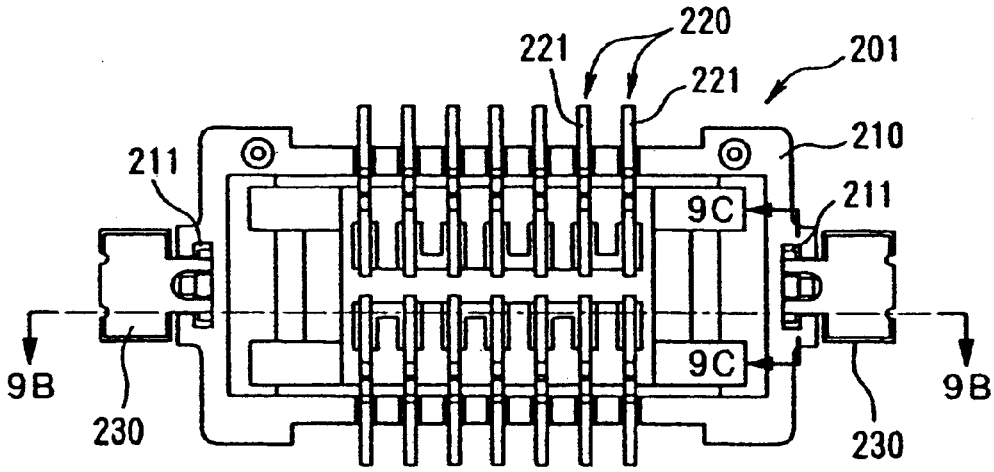
Fig.9(A) PRIOR ART
FIG. 9A is a bottom view of a surface mount type connector of the prior art.
Figure 9B:
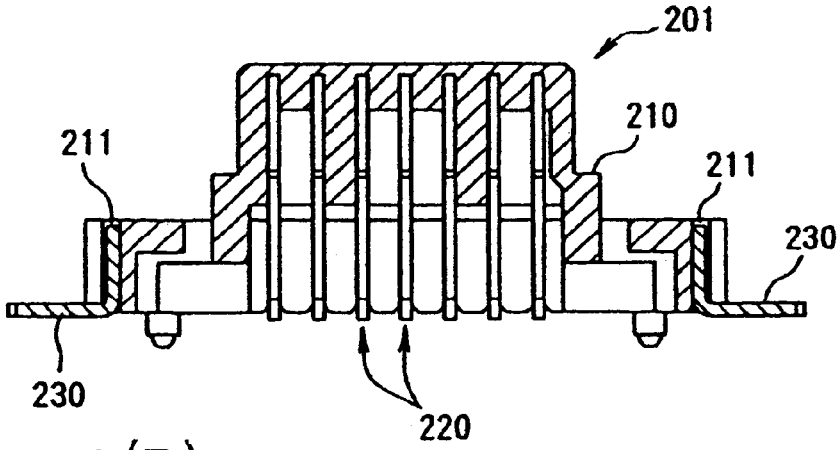
Fig.9(B) PRIOR ART
FIG. 9B is a sectional view of the surface mount type connector of the prior art taken along the line 9B—9B shown in FIG. 9A.
Figure 9C:
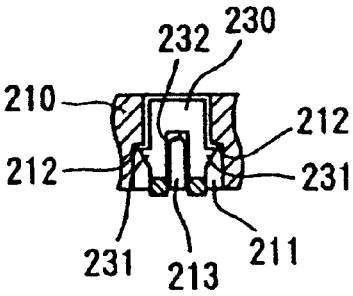
Fig.9(C) PRIOR ART
FIG. 9C is a sectional view of the surface mount type connector of the prior art taken along the line 9C—9C shown in FIG. 9A.

FIGS. 6A through 7 show a second embodiment of the card edge connector 1. The second embodiment of the card edge connector 1 has the same basic configuration as the card edge connector 1 shown in FIGS. 1A through 5, however, the latch body 40 and the fixing member 50 respectively constituting the latch members 30A and 30B have been varied. Since the latch members 30A, 30B are symmetrically arranged, only the latch body 40 and the fixing member 50 constituting the right side latch member 30B will be described herein, and it will be appreciated by those skilled in the art that the latch body 40 and the fixing member 50 constituting the left side latch member 30A will have a substantially similar configuration.

The latch body 40 has substantially the same basic configuration as the latch body 40 shown in FIGS. 1A through 3, and 5. The latch body 40 is made of a similar material as that of the first embodiment. As shown in FIG. 7, the latch body 40 comprises the press fit plate portion 41, the folded end 42, the first plate portion 43, the second plate portion 46, the daughter board holding portion 47, the anti-over movement piece 45, and the tab portion 44.

The tab portion 44, however, differs from the first embodiment in that the tab portion 44 is bent inward from the lower edge of the first plate portion 43 and extends below the second plate portion 46, as shown in FIG. 6. The tab portion 44 comprises a broad section 44*a* bent inward from the first plate portion 43 and a narrow section 44*b* narrower than the broad section 44*a* and extending inward from the tip of the broad section 44*a*. Engaging shoulders 44*c* are formed at the tip surfaces of the broad section 44*a* located on both sides of the narrow section 44*b*. An engaging aperture 44*e* is formed vertically through the narrow section 44*b* of the tab portion 44. A tilting surface 44*d*, positioned at the tip of the narrow section 44*b*, has a predetermined width and diagonally tilts upward toward the engaging aperture 44*e* from the tip of the narrow section 44*b*.

Unlike the tab portion 44 of the latch body 40 of the first embodiment shown in FIGS. 1A through 3, and 5, two projections 44*f* project upward on an upper surface of the broad section 44*a* of the tab portion 44. A pair of beads 44*g* are projected on an upper surface of the narrow section 44*b* of the tab portion 44 located on the both sides of the engaging aperture 44*e*. The height of each bead 44*g* smaller than that of the projection 44*f*.

The fixing member 50 has the same basic configuration as the fixing member 50 shown in FIGS. 1A through 1C, and 4A through 5. The fixing member 50 is made of a similar material as that of the first embodiment and is solder plated or tinned for connection by soldering. As shown in FIG. 6, the fixing member 50 comprises a plate top portion 51 extending in the bending direction of the tab portion 44, a pair of side plate portions 52 extending downward from both sides of the plate top portion 51, and a pair of plate bottom portions 53 extending toward each other from each of the lower ends of the pair of the side plate portions 52.

The plate top portion 51 of the second embodiment, however, is provided with a guide board portion 51*a* at the left end of the plate top portion 51 and an elastic engaging piece 54. The elastic engaging piece 54 is a one-legged beam extending from the left end to the right end of the plate top portion 51 in the bending direction of the tab portion 44. The elastic engaging piece 54 has a width a little narrower than that of the tilting surface 44*d* formed on the tab portion 44. The elastic engaging piece 54 has a tip set free and bent to reach slightly above the top surface of the plate bottom portion 53. The width between the pair of side plate portions 52 is larger than the width of the narrow section 44*b* such that the narrow section 44*b* can be inserted therebetween. Further, unlike the fixing member 50 shown in FIGS. 1, 4, and 5, the distance from the plate bottom portion 53 to the plate top portion 51 is larger than the sum of the thickness of the tab portion 44 and the height of the projection 44*f*.

The fixing member 50 is mounted on the tab portion 44 of the latch body 40 by pressing the guide board portion 51*a* toward the first plate portion 43 with the guide board portion 51*a* traveling adjacent to the upper surface of the bead 44*g* and the projection 44*f* of the tab portion 44, as shown in FIG. 6A. When the fixing member 50 is mounted, the narrow section 44*b* of the tab portion 44 is inserted from the tip into the space in the fixing member 50 enclosed by the plate top portion 51, the pair of side plate portions 52, and the pair of the plate bottom portions 53. When the narrow section 44*b* of the tab portion 44 is inserted from its tip into the space in the fixing member 50, then the tip of the elastic engaging piece 54 slides on the tilting surface 44*d* formed at the tip of the narrow section 44*b*, causing the elastic engaging piece 54 to deflect upward. When the tip of the elastic engaging piece 54 reaches the engaging aperture 44*e*, then the elastic engaging piece 54 returns to its original position and engages with the edge of the engaging aperture 44*e*. The left edge of the side plate portions 52 touches the engaging shoulder 44*c* formed in the tab portion 44 in the tab bending direction. When the elastic engaging piece 54 is engaged with the engaging aperture 44*e*, the tip of the elastic engaging piece 54 is designed to slide on the tilting surface 44*d*. Thus, the tip of the elastic engaging piece 54 is smoothly led to the engaging aperture 44*e*.

The movement in the bending direction of the tab portion 44 is limited by the elastic engaging piece 54 engaging with the engaging aperture 44*e* and the right edge in the tab bending direction of the side plate portion 52 touching the engaging shoulder 44*c* formed on the tab portion 44, as shown in FIGS. 6A and 6B. Simultaneously, the movement in the direction orthogonal to the bending direction of the tab portion 44 of the fixing member 50 is limited by the inside of the pair of side plate portions 52 touching the side edge of the narrow section 44*b* of the tab portion 44. After the fixing member 50 is mounted on the tab portion 44, unlike the case shown in FIG. 5, the fixing member 50 can be rotated in the vertical direction X, shown in FIG. 6B, centering on the projection 44*f*. When the lower surface of the plate top portion 51 of the fixing member 50 touches the upper surface of the bead 44*g*, the downward rotation of the fixing member 50 is limited. When the upper surface of the plate bottom portion 53 touches the lower surface of the narrow section 44*b*, the upward rotation of the fixing member 50 is limited.

In the second embodiment of the card edge connector 1, since the fixing member 50 can be rotated in the vertical direction centering on the projection 44*f*, even if the mother board A is warped, the warp can be absorbed by the rotation of the fixing member 50 in the vertical direction. Thus, the solder connection portion 21 of the contact 20 and the fixing member 50 can be successfully soldered to the mother board A. Further, although the force works on the card edge connector 1 or the latch body 40 to vertically move them upward, no impact is applied to the fixing member 50 because the projection 44*f* stays in contact with the guide board portion 51*a*. Therefore, cracking is unlikely to occur in a soldered portion. Additionally, since the projection 44*f* remains in contact with the guide board portion 51*a*, the mother board A and the daughter board B can be grounded through the latch body 40 and the fixing member 50.

While the present invention has been described in connection with the illustrated embodiments, it will be appreciated and understood that modifications may be made without departing from the true spirit and scope of the invention. For example, it should be appreciated by those skilled in the art that the shape of the fixing member 50 and the tab portion 44 are not limited to the shapes shown in FIGS. 1 through 5 so far as the fixing member 50 can be mounted on the tab portion 44 with the fixing member 50 movable in the vertical direction in a predetermined range with respect to the tab portion 44 bent from the latch body 40. In another example, the daughter board holding portion 47 of the latch body 40 may be coated with resin. Further, it is not necessary to provide the projection 44*f* on the tab portion 44 side. The projection 44*f* may be provided on the fixing member 50 side so far as the fixing member 50 can be moved in the vertical direction centering on the projection 44*f*.

I claim:

1. A card edge connector comprising:

a housing attached to a mother board;

a latch body having a housing attaching portion for attachment to the housing and a daughter board holding portion for holding a daughter board;

a tab portion formed from the latch body such that the tab portion is movable in a predetermined range in the vertical direction; and a fixing member separated from the latch body, attached to the mother board, and mounted on the tab portion.

2. The card edge connector of claim 1, wherein the tab portion limits the movement of the fixing member in a bending direction of the tab portion and in a direction orthogonal to the bending direction of the tab portion with movement in the vertical direction allowed with respect to the tab portion.

3. The card edge connector of claim 1, wherein the fixing member has a side plate portion that limits movement of the fixing member.

4. The card edge connector of claim 1, wherein the tab portion has a broad section bent from the latch body and a narrow section having a width smaller than the broad section and extending from a tip of the broad section.

5. The card edge connector of claim 4, wherein the broad section has engaging shoulders formed at tip surfaces of the broad section and located at sides of the narrow section.

6. The card edge connector of claim 1, wherein the fixing member has a plate top portion having an elastic engaging piece that extends in the bending direction of the tab portion.

7. The card edge connector of claim 6, wherein the plate top portion has side plate portions extending downward from sides of the plate top portion having a width sufficient to insert a narrow section between the side plate portions.

8. The card edge connector of claim 7, wherein the side plate portions have bottom portions extending from ends of the side plate portions having a width between the plate top portion and the plate bottom portion larger than the narrow section.

9. The card edge connector of claim 1, wherein the fixing member and the tab portion are made of metal.

10. The card edge connector according to claim 1, wherein the tab section has a projection positioned on an end portion of the tab section such that the fixing member can be rotated in the vertical direction centering on the projection.

11. A card edge connector comprising:

a housing attached to a mother board;

a latch body having a housing attaching portion for attachment to the housing and a daughter board holding portion for holding a daughter board;

a tab portion formed from the latch body having a broad section and a narrow section having a width smaller than the broad section, the tab portion being movable in a predetermined range in the vertical direction;

a fixing member separated from the latch body, attached to the mother board, and mounted on the tab portion;

the fixing member having a plate top portion having an elastic engaging piece that extends in a bending direction of the tab portion;

side plate portions extending downward from sides of the plate top portion having a width sufficient to insert the narrow section between the side plate portions; and bottom portions extending from ends of the side plate portions having a width between the plate top portion and the plate bottom portion larger than the narrow section.

12. The card edge connector according to claim 11, wherein the fixing member has a projection positioned on an end portion of the fixing member such that the fixing member can be rotated in the vertical direction centering on the projection.

13. The card edge connector according to claim 11, wherein the tab section has a projection positioned on an end portion of the tab section such that the fixing member can be rotated in the vertical direction centering on the projection.

14. The card edge connector of claim 11, wherein the broad section has engaging shoulders formed at tip surfaces of the broad section and located at sides of the narrow section.

15. The card edge connector of claim 14, wherein the plate top portions movement in the tab bending direction of the fixing member is limited by an edge in the tab bending direction of the side plate portion of the fixing member touching the engaging shoulder and the elastic engaging piece engaging an aperture.

16. The card edge connector of claim 11, wherein the plate top portion has a lower surface touching an upper surface of the narrow section to limit the downward movement of the fixing member.

17. The card edge connector of claim 11, wherein the plate bottom portion has an upper surface touching a lower surface of the narrow section to limit the upward movement of the fixing member.

18. A card edge connector comprising:

a housing attached to a mother board;

a latch body having a housing attaching portion for attachment to the housing and a daughter board holding portion for holding a daughter board;

a tab portion formed from the latch body having a broad section and a narrow section having a width smaller than the broad section, the tab portion being movable in a predetermined range in the vertical direction;

the broad section having engaging shoulders formed at tip surfaces of the broad section and located at sides of the narrow section;

a fixing member separated from the latch body, attached to the mother board, and mounted on the tab portion;

the fixing member having a plate top portion having an elastic engaging piece that extends in a bending direction of the tab portion;

side plate portions extending downward from sides of the plate top portion having a width sufficient to insert the narrow section between the side plate portions; and bottom portions extending from ends of the side plate portions having a width between the plate top portion and the plate bottom portion larger than the narrow section.

19. The card edge connector of claim 18, wherein the plate top portion has a lower surface touching an upper surface of the narrow section to limit the downward movement of the fixing member, and the plate bottom portion has an upper surface touching a lower surface of the narrow section to limit the upward movement of the fixing member.

20. The card edge connector according to claim 18, wherein the tab portion has a projection positioned on an end portion of the fixing member such that the fixing member can be rotated in the vertical direction centering on the projection.

* * * * *